US012576953B2

(12) United States Patent
Rodriguez et al.

(10) Patent No.: US 12,576,953 B2
(45) Date of Patent: Mar. 17, 2026

(54) RAPID PAYLOAD INTERCHANGEABILITY IN AUTONOMOUS VEHICLES

(71) Applicant: SeaSatellites, Inc., San Diego, CA (US)

(72) Inventors: Dylan Rodriguez, San Diego, CA (US); Michael Flanigan, San Diego, CA (US)

(73) Assignee: SeaSatellites, Inc., San Diego, CA (US)

( * ) Notice: Subject to any disclaimer, the term of this patent is extended or adjusted under 35 U.S.C. 154(b) by 127 days.

(21) Appl. No.: 18/433,834

(22) Filed: Feb. 6, 2024

(65) Prior Publication Data

US 2025/0249990 A1 Aug. 7, 2025

(51) Int. Cl.
*B63B 79/40* (2020.01)
*B63B 79/10* (2020.01)

(52) U.S. Cl.
CPC ..... *B63B 79/40* (2020.01); *B63B 79/10* (2020.01)

(58) Field of Classification Search
CPC ..... B63B 79/40; B63B 79/10
See application file for complete search history.

(56) References Cited

U.S. PATENT DOCUMENTS 12,377,946 B1 * 8/2025 Todter ..... B63B 1/24
2007/0198144 A1 * 8/2007 Norris ..... B60W 60/0053 701/23
2018/0225891 A1 * 8/2018 Lambourne ..... H01R 13/6397

* cited by examiner

*Primary Examiner* — Michael C Zarroli
(74) *Attorney, Agent, or Firm* — Scale LLP

(57) ABSTRACT

Systems and methods for rapid payload interchangeability such as for rapid payload interchangeability in autonomous vehicles. A vehicle may include a payload interface and at least one modular payload connection port. The at least one modular payload connection port may include a plurality of pins. Each of the plurality of pins may be connected to the payload interface. The system may include a user device. For the at least one modular payload connection port, the user device may be configured to receive a user selection of a first communication protocol from a plurality of communication protocols and wirelessly transmit the user selection of the first communication protocol to the payload interface. For the at least one modular payload connection port, the payload interface may be configured to enable only some of the plurality of pins based on the first communication protocol.

20 Claims, 6 Drawing Sheets

RAPID PAYLOAD INTERCHANGEABILITY IN AUTONOMOUS VEHICLES

TECHNICAL FIELD

Various aspects of the present disclosure relate generally to systems and methods for rapid payload interchangeability and, more particularly, to systems and methods for rapid payload interchangeability in autonomous vehicles.

BACKGROUND

Autonomous vehicles may employ systems configured with "plug-and-play" functionality, where users can connect various external devices and the system is able to integrate such devices into the internal vehicular environment without requiring additional installation. Such a system may be desirable in that it enhances user convenience and reduces costs associated with manually modifying existing software/hardware in order to connect a new component to the vehicle. Additionally, a system designed with enhanced "plug-and-play" functionally that can recognize and integrate payloads with varying specifications may provide an additional advantage in terms of allowing a user of the vehicle to swap a multitude of connected external devices throughout the vehicle's life span. This may be ideal in a situation where the vehicle is shared amongst an organization of members that may routinely connect/disconnect various payloads into the vehicle over time. For such a system to reliably integrate the differing payload connections, it should have the flexibility to interpret data sent via different communication protocols and different formats. Additionally, deploying such a shared system runs the risk of users accidentally connecting payloads into wrong ports of the vehicle, which may cause irreparable damage to internal components of the vehicular system. As will be described herein, a system that can integrate different payload connections as well as auto-adjust internal power settings to may be desirable.

The present disclosure is directed to overcoming one or more of these above-referenced challenges.

SUMMARY OF THE DISCLOSURE

According to certain aspects of the disclosure, systems, methods, and computer readable memory are disclosed for rapid payload interchangeability and, more particularly, to systems and methods for rapid payload interchangeability in autonomous vehicles.

Embodiments of the invention include a system for rapid payload interchangeability in an autonomous vehicle. In some embodiments, the system may include a vehicle. The vehicle may include a payload compartment, a payload interface, and at least one modular payload connection port. The at least one modular payload connection port may include a plurality of pins. Each of the plurality of pins may be connected to the payload interface. The system may include a user device. For the at least one modular payload connection port, the user device may be configured to receive a user selection of a first communication protocol from a plurality of communication protocols and wirelessly transmit the user selection of the first communication protocol to the payload interface. For the at least one modular payload connection port, the payload interface may be configured to enable only some of the plurality of pins based on the first communication protocol.

Embodiments of the invention also include one or more methods for implementing the system described above. Additional objects and advantages of the disclosed technology are set forth below, and will be directly apparent from the description, or may be learned by practice of the disclosed technology.

It is to be understood that both the foregoing general description and the following detailed description are exemplary and explanatory only and are not restrictive of the disclosed technology, as claimed.

BRIEF DESCRIPTION OF THE DRAWINGS

The accompanying drawings, which are incorporated in and constitute a part of this specification, illustrate various exemplary aspects and together with the description, serve to explain the principles of the disclosed technology.

DETAILED DESCRIPTION

Various aspects of the present disclosure relate generally to rapid payload interchangeability and, more particularly, to systems and methods for rapid payload interchangeability in autonomous vehicles.

In general, a system that can integrate a variety of technology without additional manual configuration, often referred to as "plug-and-play" functionality, allows users the freedom to connect their devices without having to experience the complexities associated with installation. Such a system often reduces non-recurring engineering (NRE) costs by eliminating the end-users' need to modify existing software/hardware when connecting a new input component. Additionally, a system designed with enhanced "plug-and-play" functionality may have wider market traction since it can recognize and integrate payloads with varying specifications, resulting in the system appealing to a larger range of prospective customers. For example, the system may be purchased and used by an organization whose members are responsible for incorporating different areas of technology into a single environment. The system may be ideal in such a scenario since it can be shared among the members, each of whom may connect an independent payload in order to perform their specific engineering tasks.

For a system to reliably accept and integrate a multitude of payloads with varying specifications, it should have the flexibility to interpret data sent via different communication protocols, which may prove challenging due to hardware constraints of the system's circuit board(s) and connecting wires. For example, it is often advantageous to use a light-weighted cable with the least number of pins when connecting a payload to a "plug-and-play" circuit board due to the costs that come with increasing the number of pins. A thicker cable with more pins requires more material, adds weight, and takes up more space in situations where size and weight may have critical importance. However, having less pins to choose from when forming the electrical connections makes it more difficult for the board to designate ports that can differentiate between different protocols. As will be described herein, a system designed with a scheme that can differentiate and accept varying communication protocols sent via a cable with a reduced number of pins may be provided. An additional concern when designing a "plug-and-play" system shared across multiple users may be the risk that a user accidentally connects a payload to the wrong port of the circuit board. For example, a payload may be configured to operate at a voltage that is less than the voltage of the port to which it is connected and, upon connection, the payload may be irreparably damaged from overvoltage. As will be described herein, a system that can auto-detect the correct supply voltage and adjust power settings accordingly may be provided.

Figure 1:
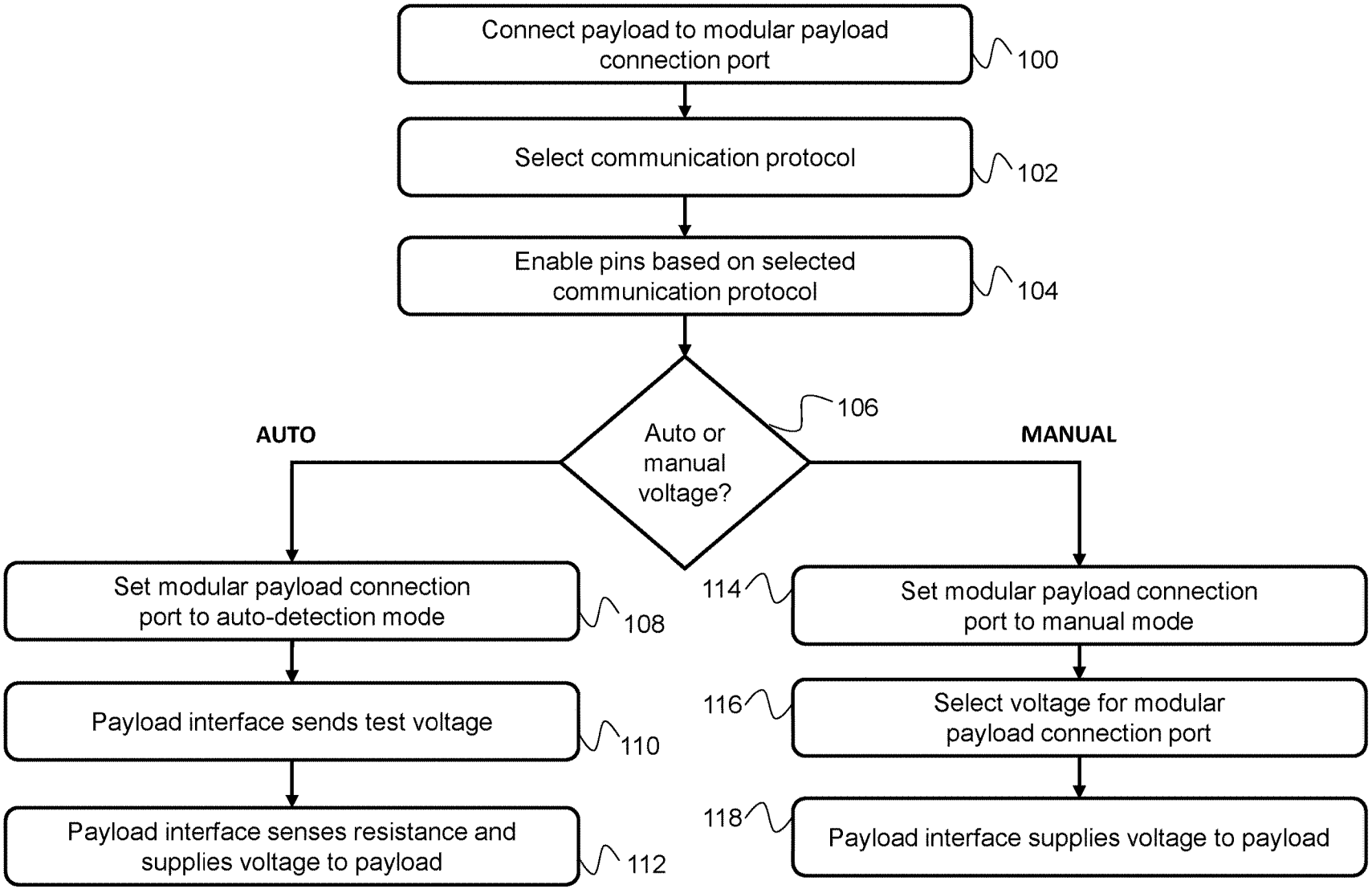
FIG. 1 depicts an example flow diagram for a system configured for rapid payload interchangeability.

FIG. 1 depicts an example flow diagram for a system configured for rapid payload interchangeability. In embodiments, such a system may be deployed on a vehicle, which may be an autonomous, semi-autonomous, self-driving, or driverless vehicle, which means it is capable of sensing its environment and moving with little or no human input. In other embodiments, the system may be deployed in a vehicle operable by a human/driver. Examples of vehicles that may deploy the system discussed herein comprise a boat, an aircraft, a drone (or any unmanned aerial vehicle (UAV)), an automobile, and/or any other autonomous, semi-autonomous, or human-controlled vehicle. In some embodiments, the vehicle may be powered using a renewable energy source. For example, the vehicle may be solar-powered, wind-powered, hydro-powered, and/or powered with other renewable energy sources. The payload may include data transmitted from an external device to an internal system of the vehicle that may useful, for example, when navigating the vehicle. The techniques described herein may provide a system where a user of the vehicle may connect a multitude of external devices configured to transmit data via payloads with varying parameters to an internal system of the vehicle which may include a payload interface and one or more modular payload connection ports managed by the payload interface.

At 100, a user may connect a payload to the modular payload connection port(s) mentioned above. As used herein, connecting a payload may be interpreted as connecting an external device configured to transmit a payload containing actual, useful data separate from overhead data. For example, payload devices may refer to instrument/equipment designed to obtain and communicate information to the internal system of the vehicle related to how to perform specific tasks/functions. Examples of different payloads may include cameras (e.g., RGB, infrared, thermal, etc., which may be used for mapping, surveillance, etc. in unmanned vehicles), sensors (for sonar mapping or biological sample collection), and/or other communication devices.

The modular payload connection ports may be connection interfaces designed to enable attachment of various payloads/components to a system. For example, the modular payload connection ports may enable voltage and data connections that ensure the attached payloads receives sufficient voltage and can communicate with the payload interface of the internal system, or in the example above, the internal system of the vehicle. Additionally, the ports may be designed within a modular framework that allows for easy integration/connection/swapping of various payloads. In some embodiments, the ports may use standardized connection interfaces/points that are compatible with a wide range of payload devices.

In some embodiments, the modular payload connection ports may comprise a plurality of pins and the payload described above may be connected to the payload interface via the plurality of pins. For example, each pin may be independently connected to the payload interface (which is shown and described in FIGS. 2 and 3) such that each can facilitate individual data transfer between the payload device and the payload interface. In some embodiments, the payloads may be connected to the pins of the modular payload connection ports via a payload connection cable. In some embodiments, the payload connection cable may consist of no more than 12 conductors, each of which is connected to a respective pin of the plurality of pins mentioned above. In the case where a 12 conductor cable is implemented, which will be used as an example herein, the modular payload connection port may include 12 pins that follow a pinout arrangement described below. For example, the conductors of the cable (also referred to as cable pins) may be individual conductive connectors disposed at the end of the cable that interface with corresponding pins of the modular payload port. This may facilitate the transmission of power, data, signals, etc. between the payload device and the payload interface. In some embodiments, the payload connection cable may consist of at least 4, 6, 8, 10, or 12 conductors. In some embodiments, a pinout may be generated to assign to each pin of the modular payload connection port a function, voltage level, communication protocol, or other information related to the transmission of data between the payload device and payload interface. As will be described herein, the assignments of the pins may be in an arrangement known to the payload interface and referenced when enabling pins designated to receive a given payload with a certain voltage and communications protocol.

At 102, after connecting the payload to the modular payload connection port, a user may select a communication protocol that will be used when transmitting information between the two entities, and accordingly between the payload and the payload interface. The communication protocol may provide rules and/or requirements that dictate the nature of the transmissions, such as syntax, synchronization, semantics, error recovery protocol, and/or other considerations related to data transmission. Example of communication protocols comprise an Ethernet protocol, serial RS232 or serial RS485 protocols, a general-purpose Input/Output (GPIO) protocol, a national marine electronics associate (NMEA) protocol, and/or a user-defined protocol.

Figure 2:
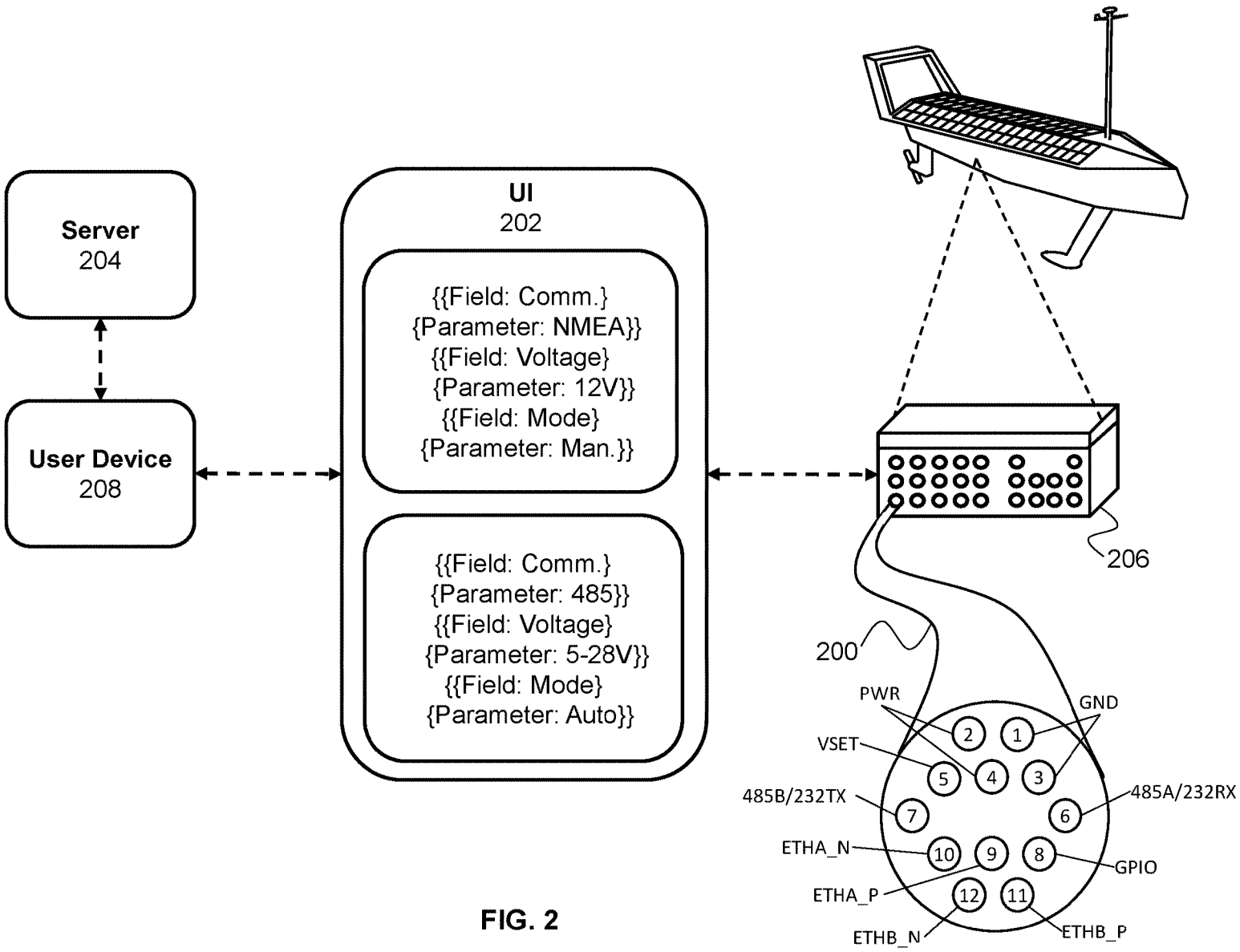
FIG. 2 depicts an example process flow between different entities of the system configured for rapid payload interchangeability.

As shown in FIG. 2, a user may enter or select, via a user interface (UI) on a user device, a value indicative of what communication protocol the connected payload uses for transmission. Examples of UI input components comprise a text boxes, dropdown lists, checkboxes, and/or other means of feeding data into the system. In the case of the input being entered via a dropdown list, a user may select, via the UI, the port ID of the modular payload connection port that has the payload connected to it. Upon selection, the UI may display to the user a list of communication protocol options from a set of all available communication protocols that the port with the given port ID can be configured with. The user may select the option that matches the protocol of the attached payload and an indication of the selected communication protocol may be sent to a database hosted on remote server, which is described further in FIG. 2, and subsequently to a payload interface on an internal system of, for example, a vehicle.

At 104, a payload interface may receive an indication of the communication protocol selected by the user as well as an indication of the port ID of the modular payload connection port. In turn, the payload interface (or controller of the payload interface) may enable some of the plurality of pins for the modular payload connection port that have been assigned/configured with the selected communication protocol based on the pinout described above. These pins may be considered data pins and may be responsible for transmitting/receiving data to and from the payload. For example, in the case where the cable attaching the payload has 12 conductors and accordingly the modular payload connection port has 12 corresponding pins, one or more pins may be assigned with a set of optional communication protocols, which may be the complete set of protocols that the system can assign to a given pin. For example, pins 1, 2, 3 and 4 may be assigned with a set of optional communication protocols that includes an Ethernet protocol (in addition to other optional protocols such as RS 485, RS 232, etc.). Upon determining that the attached payload uses Ethernet, the payload interface may reconfigure (via one or more firmware/switching modifications described in more detail below) pins 1 through 4 as data pins that use Ethernet protocol when communicating with the attached payload. These pins may be enabled by the controller, which is described below. As a result, the payload interface of the internal system of the vehicle may be able to transmit and receive data from the attached payload via the enabled pins. Determining which pins are assigned certain optional communication protocols may be based on an assessment of the specifications of the communication protocols. For example, it may be understood that in order to transmit using an Ethernet protocol, at least 4 pins must be enabled. Additionally, it may be known that a single pin may be configured to transmit using both RS 232 and RS 485 protocols. The system may consider such characteristics and determine assignments accordingly. Additionally, the assignments may be updated as differing payloads are substituted for one another. For example, at a first time interval, a first payload may be attached to the internal system of the vehicle and it may be indicated that this first payload uses an RS 232 protocol. The payload interface may respond by updating its switching configuration such that pins 1 and 2 send and receive data via an RS 232 protocol. At a second time interval, the first payload may be detached and replaced with a second payload that may use an Ethernet protocol. In some embodiments, the General Input/Output (GPIO) pin can be configured to receive analog voltage as input from a simple analog sensor or as an output to trigger a launch when a threshold is met. In response, the payload interface may update the switching configuration once more such that pins 1 and 2 are now configured to transmit via Ethernet instead of RS232. In some embodiments, a transceiver designed to support multiple communication protocols may interface with the microcontroller (or another control logic device) described herein. For example, the microcontroller can programmatically set/configure designated pins (control pins) to a high state or low state. The configuration of which pins are set to high levels and low levels may dictate which communication protocol is active during a particular interval. In some embodiments, the microcontroller can send software commands to switch between protocols (which may be a particularly useful feature if the board described herein is part of a larger digital system).

The controller may enable the pins of the port, which are connected to the corresponding conductors of the cable, by setting the pin to an "active" state. Additionally, in order to configure the pins to use the selected communication protocol from the set of optional communication protocols, the configuration of switches may be updated by the payload interface. When a common ground is connected between the payload and controller, voltage and data communications may be supplied to the payload via the activated pins. In addition to configuring/enabling the pins to transmit according to a selected communication protocol, some of the pins for a given port may be assigned as power pins and enabled to supply a voltage based on either a manual user input via the UI or auto-detection performed autonomously by the payload interface.

At 106, the user may select via the UI whether to set the voltage supplied to an attached payload in manual mode or in auto-detected mode. The selection may be performed by the user similarly to how the communication protocol was selected. For example, a user may attach the payload into modular payload connection port tagged in the system as port ID 1. The UI may display a "mode" field graphic under port ID 1 to the user and in response to the user clicking the graphic, a dropdown list may be displayed that shows options for what mode to use when setting the voltage for the given modular payload communication port: manual mode or auto-detected mode. In manual mode, a user may be required to input the voltage level for a given port. In auto-detected mode, the system may set the voltage level based on the operating voltage detected from the payload. In some embodiments, the auto-detected mode may be the default mode where if a user provides no indication of a mode for a port, it will be set to auto-detected. Additionally, just like the communication protocols, the mode selected for each port can change/update over time as payloads with different characteristics are substituted for one another. For each payload subsequently attached to a port, a user may have to refresh the UI and update the mode of the port using the same technique described above. In response to each update, the payload interface may reconfigure automatically without the need for a user to perform any manual hardware modifications. Additionally, at any given time, some of the ports may be in manual mode while others are in auto-detected mode. The system's ability to integrate payloads with different communication protocols and voltage levels, which often involve distinct hardware/software components, may reduce costs associated with installation.

At 108, the modular payload connection port described above is set to auto-detected mode. While in such a mode, the port may be considered adaptive in that it can supply via power pins (which may be separate from the data pins configured with communication protocol described above) variable voltage that matches the voltage that the payload uses to operate. Additionally, the indication that a given modular payload connection port should be set to auto-detect mode may be relayed from the remote servers to the payload interface, which may respond by marking (e.g., flagging a register) the port with auto-detected mode. The process flow between the remote servers and the internal system of the vehicle, including the payload interface, is described further in FIG. 2. In some embodiments, a range of voltage levels that a given modular payload connection port can output may be displayed on the UI to the user so that the user can choose a suitable port for the payload. In some embodiments, when a given modular payload connection port is selected to be in auto-detected mode, a stimulus indicative of the mode may be triggered and presented to the user. The purpose of the stimulus may be to inform the user that it is safe to connect any payload, regardless of its voltage requirements, into the given modular payload connection port. The payload interface will automatically detect the payload's voltage and adjust the voltage level of the port accordingly. In other words, a user may not fear the risk of damaging the payload by connecting it to a port that supplies too much voltage. In some embodiments, the stimulus may be a green light emitting diode (LED) disposed above the port in auto-detected mode. The circuitry of the payload interface may be configured such that when sufficient voltage is applied to power pins of an auto-detected port, a control signal may be sent to a power source (such as a GPIO pin) and, in response, the source may drive the illumination of the LED or another external device used as a stimulus. Examples of stimuli may include other visual means, audio, haptic feedback, or other feedback that can alert a user of the current mode.

At 110, the payload interface attached to the modular payload connection port may send a "test" voltage. As will be explained herein, this "test" voltage may be used by the payload interface when determining the voltage supply to be outputted by the assigned power pins of the modular payload connection port. In some embodiments, all power pins of the modular payload connection ports (including the ports set to manual mode) may initially apply 0 Vs, even if a payload has been attached. Upon the user selecting to sync the payload with the internal system of the vehicle, the payload interface may send a small voltage and subsequently sense a particular resistance value. In some embodiments, some of the pins of the modular payload port may be configured with resistors (either by a user manually soldering resistors onto the cable in between the conductors and port pins or by configuring a series of switches using the payload interface board described with respect to FIG. 4).

In 112, the payload interface (or the controller of the payload interface) may monitor for the presence of a resistor placed between a control signal (e.g., Vset wire described in FIG. 3) and ground for a given port and, upon detecting the resistor, the resistor's value may be derived and mapped to a voltage desired by the payload. In some embodiments, the desired voltage may be inferred based on the derived resistor's value. In response, the payload interface may supply voltage equal to the desired voltage to the power pins of the port, which may then output the voltage supply to the payload via cable conductors corresponding to the power pins. Further details about how the payload interface may infer and output a desired voltage based on resistor values are provided in FIG. 3.

Returning to 106, the user may select to set the modular payload connection port described above to manual mode instead of auto-detected mode. Upon selecting manual mode, the modular payload connection port is set to manual mode at 114. At 116, the UI may display a text box (or any of the other UI input prompts described above) where a user may enter a voltage level (V level) to be output by the corresponding port, which would likely be equal to the voltage level desired by the payload. In some embodiments, the system may infer that the user intends to set a particular modular payload connection port to manual mode based on the user directly inputting, via the UI, a parameter value for the voltage field of the port ID associated with the modular payload connection port, as shown in FIG. 2. For example, when a user selects a particular port ID via the UI, individual graphics representing the communication protocol field, the voltage field, and the mode field may be displayed to the user. The user may be able to select the voltage field graphic and directly enter a value for the port ID. In such a case, the system may override the default auto-detected mode and enable manual mode for the port ID without the user having to explicitly enter it using the mode field graphic. As mentioned above, the user may press a sync button on the UI and the remote servers may send an indication of the port ID, the selected manual mode, and the voltage value entered by the user to the payload interface of the internal system of the vehicle.

At 118, the payload interface may obtain the indication mentioned above and supply voltage equal to the voltage value entered by the user across the power pins of the modular payload connection port associated with the port ID. In some embodiments, the payload interface (or controller of the payload interface) may first identify, based on the received indication, that the port ID should be marked under manual mode. In such a case, the payload interface may be able to skip/bypass steps only relevant when setting a port in auto-detected mode (sensing the resistor, deriving the resistance value, etc. which are described above) and directly update the switching configuration. Such voltage may be fixed, leading to the voltage outputted by the power pins to remain constant regardless of the payload attached. Given this, a payload that is accidentally plugged into this port may risk damage if its operating voltage (e.g., the payload is a low-voltage sensor) is less than the output voltage of the port. To prevent such damage, a stimulus may be presented alerting the user to be careful when attaching a payload to the manually set port.

When the power pins of the modular payload connection port are applying the correct voltage level as indicated by the payload interface, a control/confirmation signal may be generated and sent to a power source of the payload interface (e.g., a GPIO pin). Similar to how the green LED is illuminated, the circuitry of the payload interface may configure the power source to trigger a stimulus in response to receiving the control signal. For example, the stimulus may be an external red LED and the power source may drive the illumination of the red LED. The purpose of the stimulus may be to alert the user that a given modular payload connection port has been manually set to a certain voltage.

FIG. 2 depicts an example process flow between different entities of the system configured for rapid payload interchangeability. As shown, the system may include a cable 200 housing conductors that connect to respective pins of a modular payload connection port, a user interface 202 displayed on a user device 208, one or more remote servers 204, a client device 208, and/or a payload interface 206 that controls the modular payload connection ports and is a hardware component of an internal system of the vehicle. Each of the foregoing is described in detail below. Additionally, an example of steps involved when attaching a sensor as a payload may be provided to better illustrate the process flow.

A cable 200 may be used by a user to connect a payload to a modular payload connection port. The cable 200 may be identical to the cable described in FIG. 1. For example, the cable 200 may house conductors that connect to respective pins of the modular payload connection port. For example, a first conductor may connect to a power pin of the modular payload connection port while a second conductor may connect to a data pin that communicates via an RS232 protocol. As an example, a user may decide to connect a sensor as a payload to the internal system of vehicle. For example, the sensor may be a dissolve oxygen (DO) sensor configured to measure the amount of oxygen dissolved in the body of water that the vehicle is navigating. To help the sensor integrate with the internal system, a user may provide specifications of the sensor such as its transmission communication protocol, its operating voltage, the data format it uses when sending data, and/or other specifications related to how the sensor exchanges information. The data format may dictate how the data is organized within the sent data structure. For example, a component of the data format that may be provided to assist in integration may be data type such as does the data consist of integers, characters, etc. As discussed in FIG. 1, such information may be inputted by the user via the UI 202.

The UI 202 may be a software interface hosted on a user device 208 configured to run a software application. While user device 208 is running the application, the UI 202 may continuously display renderings of the current states (which may be the parameter values assigned to each field) of each modular payload connection port (tagged with a port ID) of the internal system to the user (each port may have a unique payload connected to it). For example, the current state of port ID 1 may show one or more of the following: its communication protocol field is set to a parameter value of NMEA, its voltage field is set to 12 V, and its mode field is set to manual. In some embodiments, the parameter values of each of these fields may be empty. The UI 202 may allow a user to input/update the parameters values of any of the port IDs. Using the DO sensor/payload example described above, a user may attach the payload to a modular payload connection port associated with port ID 1. The user may then select a port ID 1 graphic on the UI 202, which may in turn populate the different fields as well input prompts for the parameter value of each field. The user may know that the DO sensor communicates with a serial RS 232 protocol, operates at a voltage of 12 V, and outputs data in a format of a single integer. Accordingly, the user may update each field of port ID 1 using the UI 202. Information pertaining to the user inputs may be sent from the user device 208 to remote servers 204, for example, upon the user pressing a sync button. In some embodiments, the user device 208 may send this information directly, via wired or wireless means, to the internal system of the vehicle. In such a case, the user device 208 may be configured to communicate with the internal system of the vehicle without requiring the intervention of remote servers, or any other third-party software systems. In some embodiments, the user device 208 may act as the remote server described above, whereby a user may interface with the remote server managing their data without being physically present. For example, the UI 202 described herein may be a web-based control panel that allows a user to access and interact with the remote server via a web browser hosted locally. The user device 208 may be a personal computing device, such as a cell phone, a tablet, a laptop, or a desktop computer. In some embodiments, the user device 208 may be associated with a user (e.g., a driver or passenger of the vehicle). The user may have a user account associated with the user device 208 that uniquely identifies the user (within the remote servers 204).

The remote servers 204 may coordinate data and/or instructions between the user device 208 and the internal system of the vehicle. In some embodiments, the remote servers 204 may also manage a database that stores data related to the current status (described above) of each modular payload connection port of the internal system of vehicle. The database may also store relevant data for the vehicle. In some embodiments, upon the user pressing the sync button on the UI 202, a file containing the user input information described above may be uploaded to the remote servers 204 via wireless transmission. The remote servers 204 may execute a function to compare the input information with corresponding entries of the database to evaluate if any of the entries need to be updated. The remote servers 204 may wirelessly transmit information related to how to set each parameter value of a modular payload connection port to the payload interface 206 contained within the internal system of the vehicle.

The internal system of the vehicle may include software configured to parse the parameter values from the information sent from the remote servers 204. The software may generate commands to be translated into machine instructions that the payload interface 206 may follow when configuring each of the modular payload connection port (which is described in FIG. 1). In some embodiments, the internal system of the vehicle may transmit data received from the payload to the remote servers 204 while the payload is in use (after the ports have been configured for the payload and the payload has been fully integrated into the internal system of the vehicle). In the DO sensor example, a stream of single value data samples generated by the sensor may be sent to the internal system of the vehicle. Software may parse the data samples from overhead data and send such data to the remote servers 204, which may perform additional analysis on the data. In some embodiments, the remote servers 204, which has a mapping stored at the database of which port ID is connected to which payload, may provide such analytics to the UI 202 such that the user of the vehicle can see an output of the payload (e.g., the user may download a csv file of the outputs). For example, in the case of using a DO sensor, a UI 202 may display a graph colorized based on a function of the vehicle's path and dissolved oxygen level.

Figure 3:
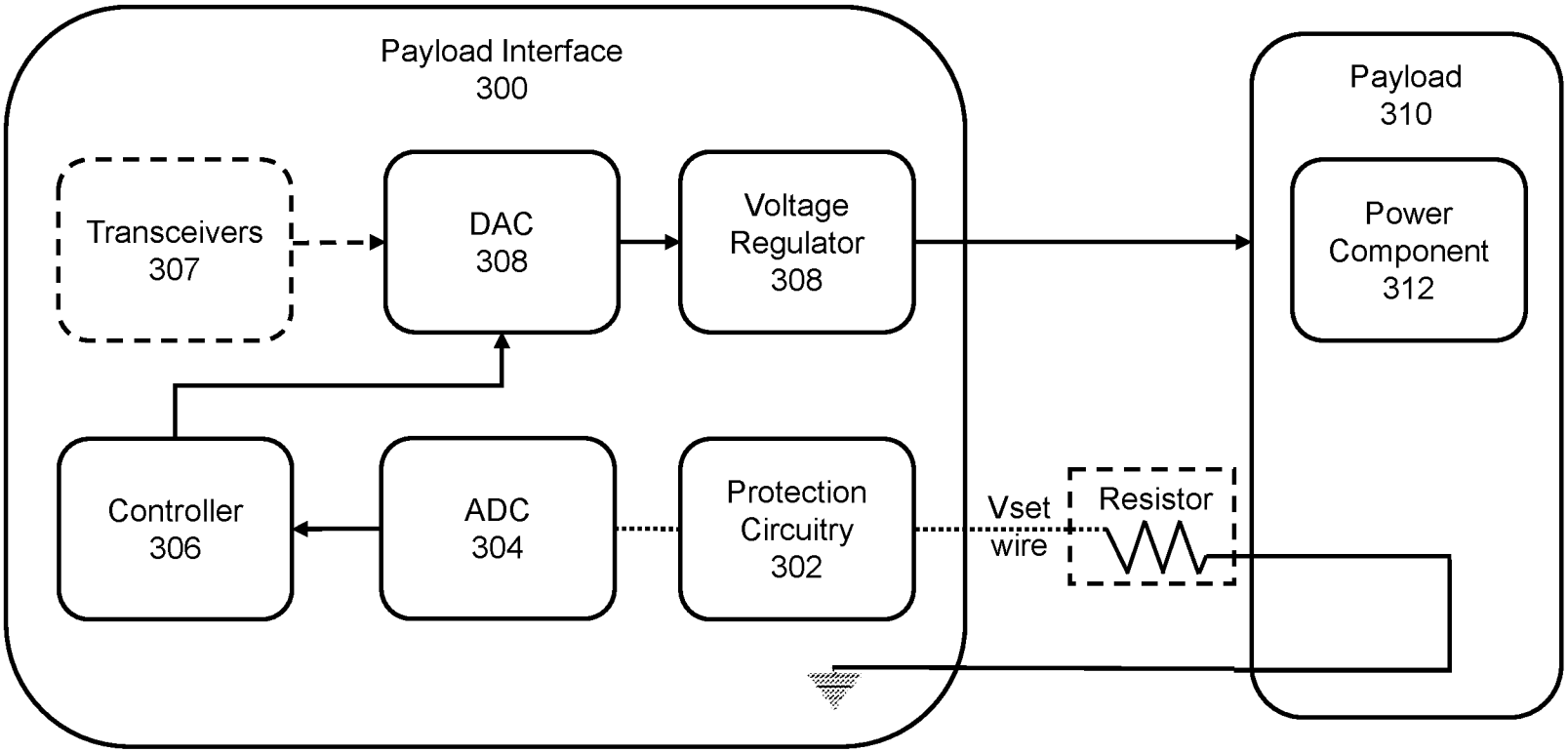
FIG. 3 depicts an example architecture of a system for rapid payload interchangeability.

FIG. 3 depicts an example architecture of a system for rapid payload interchangeability. As shown, the system may include a payload interface 300 (which itself, for example, may comprise one or more printed circuit boards, chips, and other circuitry for practicing one or more embodiments of the present invention) that houses protection circuitry 302, one or more ADCs 304, one or more controllers 306, one or more DACs 308, and a voltage regulator 308. The payload interface may be in communication with a payload that houses a power component 312. Each of the foregoing is described further herein.

A payload 310 may be attached to a modular payload connection port disposed on a surface of the housing of the payload interface 300. Additionally, the payload interface 300 may obtain instructions on how to set each pin of the modular payload connection port based on the user selections and may update its circuitry accordingly, which is described in FIGS. 1 and 2. In some embodiments, a user selection may indicate to set a port to auto-detected mode and the payload interface 300 may mark the port accordingly. Additionally, the process for supplying voltage to a payload 310 attached to a port marked as auto-detected may be different than if the payload 310 was attached to a port marked as manual. One or more of the techniques described below may apply only to auto-detection and may be skipped when a user manually configures voltage levels.

In order to apply the correct voltage across the power pins of a modular payload connection port set to auto-detected mode, the payload interface 300 may have to negotiate, or in other words execute a data handshake, with the payload 310. The purpose of the negotiation may be to assess the voltage level that the payload 310 desires to be supplied with by the output power pins. In some embodiments, a multitude of resistors with unique resistance values may be placed between the payload 310 and payload interface 300 and mapped to particular voltages. As described in FIG. 1, the resistors may be placed between a control signal carried by the Vset wire, and a ground for a modular payload port. For example, the resistors may be soldered onto the cable used to connect the payload 310. Alternatively, the payload interface board described in FIG. 4 may deploy a series of switches mapped to respective resistors. When one of these switches is switched "on" by a user, the mapped resistor may be connected to the Vset wire. The payload interface 300 (or the controller 306 of the payload interface 300) may monitor the Vset wire of a given port for the presence of a resistor. To begin the negotiation, the payload interface 300 may send a test voltage that triggers detection of a particular resistor. In some embodiments, the controller 306 may send a command to the voltage regulator 308 to send the test voltage.

The protection circuitry 302 of the payload interface 300 may comprise a voltage sensing mechanism that monitors the voltage levels of the control signal by continuously comparing it to a reference voltage. In some embodiments, the protection circuitry 302 may include a comparator designed to generate an output signal if the difference between the voltage level of the control signal and the reference voltage crosses a threshold. Such an output signal may alert the payload interface 300 that a voltage drop is present, thus a resistor has been detected. In some embodiments, the voltage drop may be commensurate with the resistance value. The protection circuitry 302 may include overvoltage protection components such as Zener diodes and voltage suppressor diodes as well as overcurrent protection such as fuses and breakers. After the control signal and testing signal have been processed by the protection circuitry 302, they may be sent to the ADCs 304.

The ADCs 304 may obtain the control signal and testing signal from the protection circuitry 302 and convert such signals into digital form. The ADC(s) 304 may include a plurality of ADCs 304. The ADCs 304 may first convert the control signal to a series of control data samples and the testing signal to a series testing data samples, where each of the data samples comprises discrete data points collected based on a sampling rate. In some embodiments, the ADC(s) 304 may have a sampling rate optimized to minimize the likelihood of deriving an erroneous resistor value. Both sets of samples may be sent to the controller 306 in order to derive the resistance value of the detected resistor.

The controller 306 may obtain the samples and derive the resistance value of the detected resistor. Since each resistance value is mapped to a unique testing voltage (as mentioned above), by deriving the resistance value, a voltage desired by the payload may be inferred. The controller 306 may derive the resistance value by comparing the discrete data points of the control data sample with the discrete data points of the testing data sample. Based on such a comparison, the voltage drop described above may be calculated and since such a drop is commensurate with the resistance value, an inference of the resistance value of the detected resistor may be made. Upon the controller 306 deriving the voltage desired by the payload 310, voltage data samples that will be used to apply the voltage across the power pins of the port may be generated by the payload interface 300 and be sent to the DAC 308.

The transceiver(s) 307 may include components configured to both send (i.e., transmitters) and receive (i.e., receivers) digital signals through wireless and/or wired connections. In alternative embodiments, transmitters and receivers may be separate components of the system. The implementation of the transceivers 307 may allow the internal system of the vehicle to connect to various devices that may send instructions or other information to the system related to one or more operating modes and/or configuration settings. Such devices may include the remote servers, the user device, the user device acting as a remote server, and/or other software services described herein.

As mentioned above, each transceiver 307 of the system may be configured to communicate using a unique communication protocol. Upon the controller 306 selecting a protocol to be used, for example, based on an output of the comparator, an output signal may be sent to an input of the transceiver 307 that is configured with the selected protocol. In such a case, the transceiver 307 may be enabled. In some embodiments, the controller 306 may be pre-configured to track which transceivers 307 are enabled at any given time (e.g., upon enabling the transceiver 308, the controller 306 may tag it as enabled by flagging a register associated with the transceiver 307).

The DAC 308 may include a plurality of DACs 308. The DACs 308 may convert the series of voltage data samples into the analog voltage signals. The analog voltage signals as well as the desired voltage derived by the controller 306 may be sent to the voltage regulator 308.

The voltage regulator 308 may receive the desired voltage and set it as the regulated voltage output to the given port. Examples of the types of voltage regulators that may be used are linear regulators (where a variable resistance component drops the voltage), switching regulators (controlling the average value of the outputted voltage by performing rapid successions of switches), series regulators, shunts regulators, and/or other voltage regulators. After the voltage regulator 308 has been set to output the desired voltage to the given port, the payload interface 300 may enable the regulator output to supply the regulated voltage to the power pins of the given modular payload connection port.

As mentioned above, the power pins of the modular payload connection port may be connected to respective conductors of the cable connected to the payload 310. The conductors may be connected to power component(s) 312 of the payload, which may include internal components/modules that consume and manage the voltage output by the voltage regulator 308.

Figure 4:
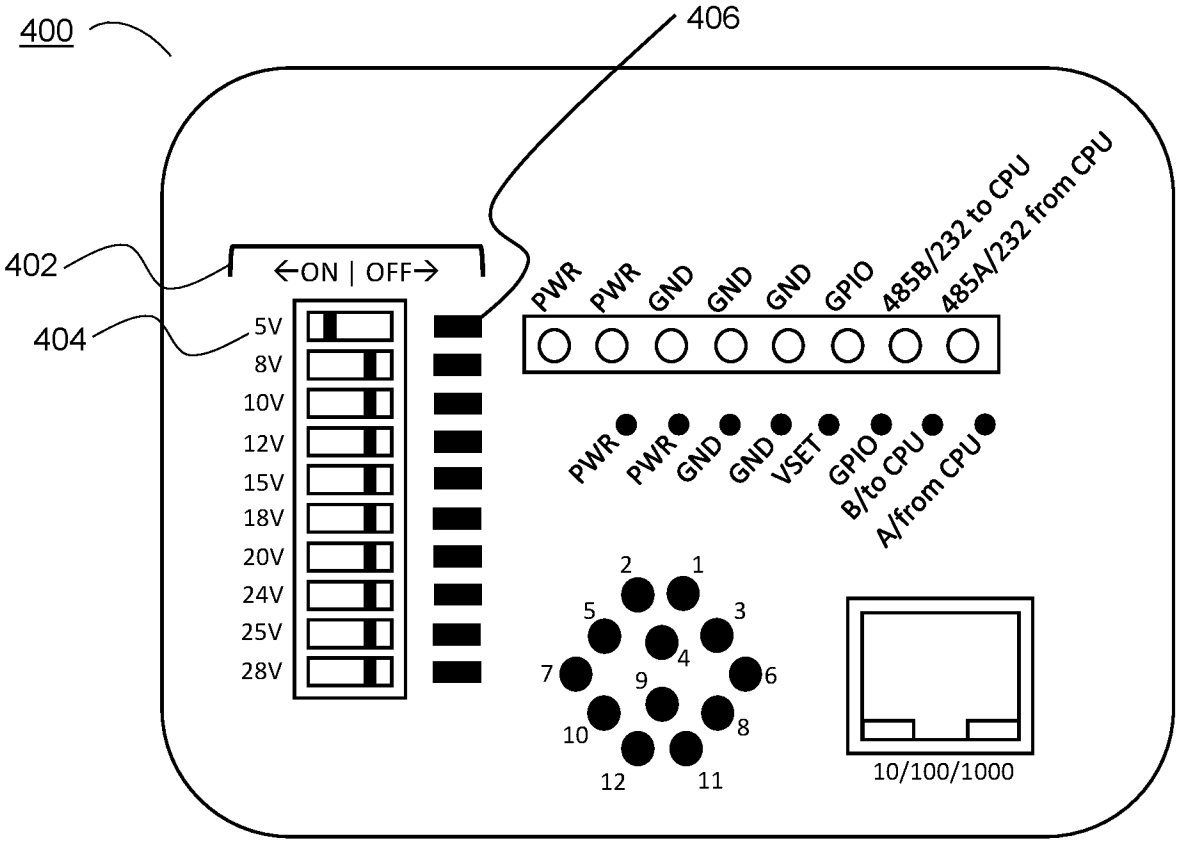
FIG. 4 depicts an example payload integration board configurable by a user to map resistance values to switching configurations.

FIG. 4 depicts an example payload integration board 400 configurable by a user to map resistance values to switching configurations. A series of switches 402 may be disposed on the payload interface board 400, where each switch may map a voltage to respective resistor with a unique resistance value. When one of these switches is flipped by a user, the mapped resistor may be connected to the Vset wire described in FIG. 3. When a testing voltage equals the mapped voltage of a connected resistor, the resistor may be detected by the payload interface and the steps outlined in FIG. 3 may follow. For example, the top switch shown in FIG. 4 may map a 5 volt level 404 to resistor 10 406. A user may flip the top switch on, in which case resistor 10 406 may be connected to the Vset wire, which is monitored by the payload interface. If a testing voltage equal to 5 Vs 404 is sent by the payload interface as described in FIG. 3, resistor 10 406 may be detected by the payload interface. The 5Vs 404 may be indicative of voltage desired by the payload.

Other components of the payload interface board may include a physical interface (such as an Ethernet connector) designed to facilitate the connection (the transfer of data) with the payload connected to the payload interface. In some embodiments, the payload interface board may include and/or employ a board-to-wire connector that allows different types of payload cables to be connected and disconnected to the payload interface board without the need for additional hardware installation (which often requires manual intervention using specialized tools such as soldering irons, crimping tools, etc.). Incorporating this toolless board-to-wire connector may be particularly useful for the system discussed above given the system's enhanced "plug-and-play" functionality.

Figure 5:
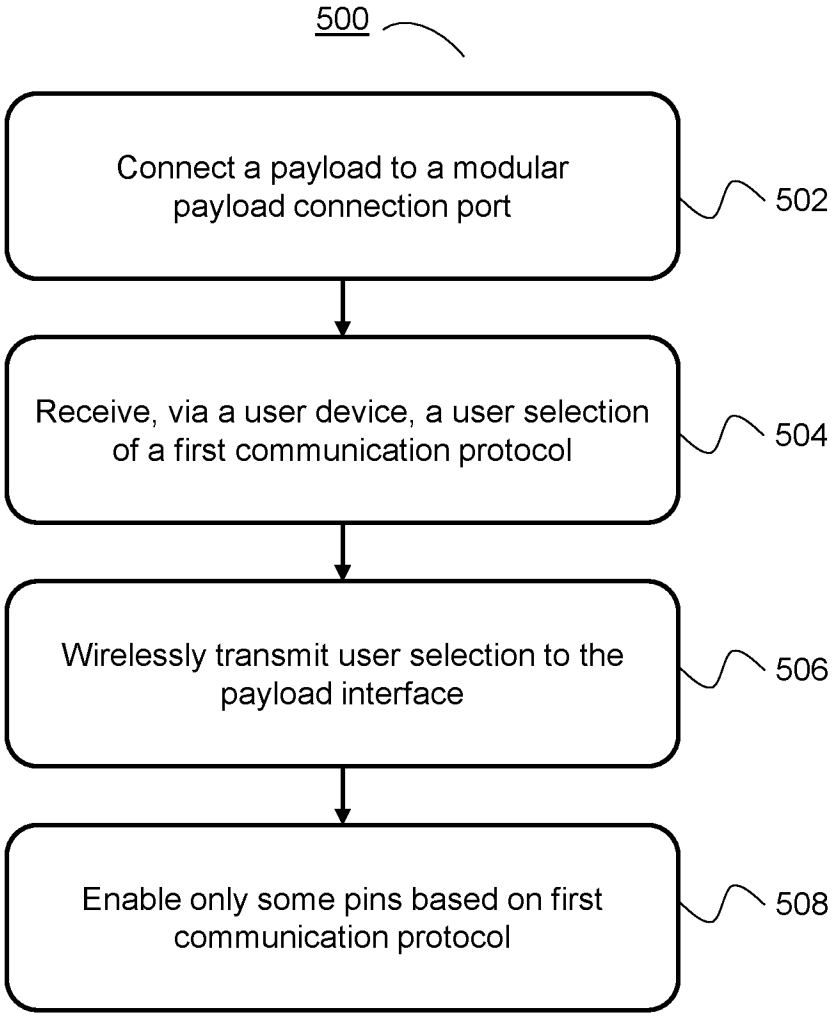
FIG. 5 depicts a flowchart of an exemplary routine for rapid payload interchangeability in an autonomous vehicle.

FIG. 5 depicts a flowchart of an exemplary routine 500 for rapid payload interchangeability in an autonomous vehicle. The routine 500 may be performed by a system configured for rapid payload interchangeability in an autonomous vehicle. In some embodiments, the system may include a vehicle. The vehicle may include a payload compartment, a payload interface, and at least one modular payload connection port. The vehicle may be a solar-powered autonomous boat.

At 502, a payload may be connected to a modular payload connection port comprising a plurality of pins. For example, at least one modular payload connection port may include a plurality of pins. Each of the plurality of pins may be connected to the payload interface. The payload may be connected to the modular payload connection port by a payload connection cable. For example, the payload connection cable may have no more than twelve conductors. Each of the conductors may connect to a respective pin of the plurality of pins disposed on the at least one modular payload connection port.

At 504, a user selection of a first communication protocol from a plurality of communication protocols may be received via a user device. For example, the system may include a user device. For the at least one modular payload connection port, the user device may be configured to receive a user selection of a first communication protocol from a plurality of communication protocols (which may include an Ethernet protocol, a serial RS232 protocol, a serial RS485 protocol, a GPIO protocol, a NMEA protocol, and/or a user-defined protocol). In some embodiments, at least one user selection of a configuration setting of the first communication protocol may be received via the user device. In some embodiments, a user selection of a first voltage from a plurality of voltages may be received via the user device. In some embodiments, user input may be received, via the user device, to select a power mode for the at least one modular payload connection port. The power mode may be one of a user-selected voltage mode and an auto-detected voltage mode.

At 506, the user selection of the first communication protocol may be wirelessly transmitted to the payload interface. In some embodiments, a user selection of first voltage from a plurality of voltages may be wirelessly transmitted to the payload interface.

At 508, only some of the plurality of pins may be enabled based on the first communication protocol. For example, for the at least one modular payload connection port, the payload interface may be configured to enable only some of the plurality of pins based on the first communication protocol. In some embodiments, a voltage may be supplied to the payload based on the first voltage described above. In some embodiments, a payload interface may sense a resistance on the at least one payload connection cable and a voltage may be supplied to the payload based on the sensed resistance. In some embodiments, the payload interface may be configurable by a user to select one of a plurality of resistances. In such a case, the payload interface may sense the selected resistance of the plurality of resistances and a voltage may be supplied to the payload based on the sensed resistance.

Figure 6:
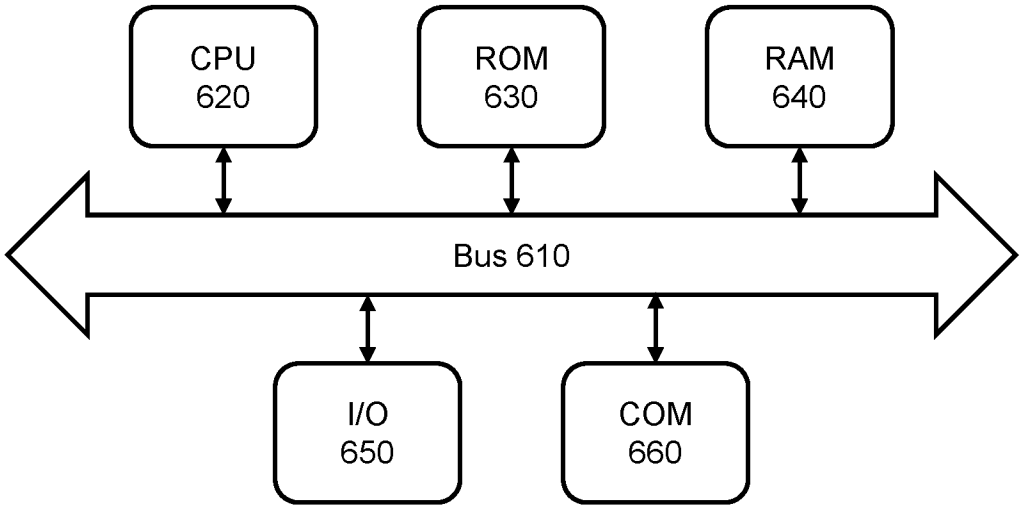
FIG. 6 depicts an example system that may execute methods described below.

FIG. 6 depicts an example system, including a computer, that may execute one or more embodiments of the invention. Specifically, the computer (or "platform" as it may not be a single physical computer infrastructure) may include a data communication interface 660 for packet data communication. The platform may also include a central processing unit ("CPU") 620, in the form of one or more processors, for executing program instructions. The platform may include an internal communication bus 610, and the platform may also include a program storage and/or a data storage for various data files to be processed and/or communicated by the platform such as ROM 630 and RAM 640, although the system 600 may receive programming and data via network communications. The system 600 also may include input and output ports 650 to connect with input and output devices such as keyboards, mice, touchscreens, monitors, displays, etc. Of course, the various system functions may be implemented in a distributed fashion on a number of similar platforms, to distribute the processing load. Alternatively, the systems may be implemented by appropriate programming of one computer hardware platform.

The general discussion of this disclosure provides a brief, general description of a suitable computing environment in which the present disclosure may be implemented. In some cases, any of the disclosed systems, methods, and/or graphical user interfaces may be executed by or implemented by a computing system consistent with or similar to that depicted and/or explained in this disclosure. Although not required, aspects of the present disclosure are described in the context of computer-executable instructions, such as routines executed by a data processing device, e.g., a server computer. Those skilled in the relevant art will appreciate that aspects of the present disclosure can be practiced with other communications, data processing, or computer system configurations.

Aspects of the present disclosure may be embodied in a special purpose computer and/or data processor that is specifically programmed, configured, and/or constructed to perform one or more of the computer-executable instructions explained in detail herein. While aspects of the present disclosure, such as certain functions, are described as being performed exclusively on a single device, the present disclosure may also be practiced in distributed environments where functions or modules are shared among disparate processing devices, which are linked through a communications network, such as a Local Area Network ("LAN"), Wide Area Network ("WAN"), and/or the Internet. Similarly, techniques presented herein as involving multiple devices may be implemented in a single device. In a distributed computing environment, program modules may be located in both local and/or remote memory storage devices.

Aspects of the present disclosure are stored and/or distributed on non-transitory computer-readable media, including magnetically or optically readable computer discs, hardwired or preprogrammed chips (e.g., EEPROM semiconductor chips), nanotechnology memory, biological memory, or other data storage media. Alternatively, computer implemented instructions, data structures, screen displays, and other data under aspects of the present disclosure are distributed over the Internet and/or over other networks, including wireless networks, on a propagated signal on a propagation medium (e.g., an electromagnetic wave(s), a sound wave, etc.) over a period of time, and/or they may be provided on any analog or digital network (i.e., packet switched, circuit switched, or other scheme).

Program aspects of the technology may be thought of as "products" or "articles of manufacture" typically in the form of executable code and/or associated data that is carried on or embodied in a type of machine-readable medium. "Storage" type media include any or all of the tangible memory of the computers, processors or the like, or associated modules thereof, such as various semiconductor memories, tape drives, disk drives and the like, which may provide non-transitory storage at any time for the software programming. All or portions of the software may at times be communicated through the Internet or various other telecommunication networks. Such communications, for example, may enable loading of the software from one computer or processor into another, for example, from a management server or host computer of the mobile communication network into the computer platform of a server and/or from a server to the mobile device. Thus, another type of media that may bear the software elements includes optical, electrical, and electromagnetic waves, such as used across physical interfaces between local devices, through wired and optical landline networks and over various airlinks. The physical elements that carry such waves, such as wired or wireless links, optical links, or the like, also may be considered as media bearing the software. As used herein, unless restricted to non-transitory, tangible "storage" media, terms such as computer or machine "readable medium" refer to any medium that participates in providing instructions to a processor for execution.

The terminology used above may be interpreted in its broadest reasonable manner, even though it is being used in conjunction with a detailed description of certain specific examples of the present disclosure. Indeed, certain terms may even be emphasized above; however, any terminology intended to be interpreted in any restricted manner will be overtly and specifically defined as such in this Detailed Description section. Both the foregoing general description and the detailed description are exemplary and explanatory only and are not restrictive of the features, as claimed.

As used herein, the terms "comprises," "comprising," "having," including," or other variations thereof, are intended to cover a non-exclusive inclusion such that a process, method, article, or apparatus that comprises a list of elements does not include only those elements, but may include other elements not expressly listed or inherent to such a process, method, article, or apparatus.

In this disclosure, relative terms, such as, for example, "about," "substantially," "generally," and "approximately" are used to indicate a possible variation of +10% in a stated value.

The term "exemplary" is used in the sense of "example" rather than "ideal." As used herein, the singular forms "a," "an," and "the" include plural reference unless the context dictates otherwise.

Other aspects of the disclosure will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A system for rapid payload interchangeability in an autonomous vehicle, comprising:

a vehicle, comprising:

a payload interface;

at least one modular payload connection port associated with the payload interface, wherein the at least one modular payload connection port comprises a plurality of pins, and wherein each of the plurality of pins is connected to the payload interface; and a user device, wherein the user device is configured to, for the at least one modular payload connection port:

receive a user selection of a first communication protocol from the plurality of communication protocols, wirelessly transmit the user selection of the first communication protocol to the payload interface, receive a user selection of a first voltage from a plurality of voltages, and wirelessly transmit the user selection of the first voltage to the payload interface; and wherein the payload interface is configured to, for the at least one modular payload connection port:

enable only some of the plurality of pins based on the first communication protocol, and supply a voltage based on the first voltage.

2. The system of claim 1, wherein the vehicle further comprises at least one payload connection cable, wherein the at least one payload connection cable connects the at least one modular connection port to a payload.

3. The system of claim 2, wherein the payload interface is further configured to sense a resistance on the at least one payload connection cable and supply a voltage to the payload based on the sensed resistance.

4. The system of claim 2, wherein the payload interface is configurable by a user to select one of a plurality of resistances; and wherein the payload interface is further configured to sense the selected resistance of the plurality of resistances and supply a voltage to the payload based on the sensed resistance.

5. The system of claim 2, wherein the payload connection cable has no more than twelve conductors, and wherein each of the conductors connects to a respective pin of the plurality of pins on the at least one modular payload connection port.

6. The system of claim 1, wherein the user device is further configured to receive user input to select a power mode for the at least one modular payload connection port, wherein the power mode is one of a user-selected voltage mode and an auto-detected voltage mode.

7. The system of claim 1, wherein the plurality of communication protocols comprises at least two of:

an Ethernet protocol;

a serial RS232 protocol;

a serial RS485 protocol;

a general-purpose input/output (GPIO) protocol;

a national marine electronics association (NMEA) protocol; and a user-defined protocol.

8. The system of claim 7, wherein the user device is further configured to receive at least one user selection of a configuration setting of the first communication protocol.

9. The system of claim 1, wherein the vehicle is a solar-powered autonomous boat.

10. A method for rapid payload interchangeability in an autonomous vehicle, comprising:

connecting a payload to a modular payload connection port of the autonomous vehicle, wherein the modular payload connection port comprises a plurality of pins connected to a payload interface associated with the modular payload connection port;

receiving, via a user device, a user selection of a first communication protocol from the plurality of communication protocols;

wirelessly transmitting, via the user device, the user selection of the first communication protocol to the payload interface;

enabling only some of the plurality of pins based on the first communication protocol;

receiving, via the user device, a user selection of a first voltage from a plurality of voltages;

wirelessly transmitting, via the user device, the user selection of the first voltage to the payload interface; and supplying a voltage to the payload based on the first voltage.

11. The method of claim 10, wherein the payload is connected to the modular payload connection port by a payload connection cable.

12. The method of claim 11, further comprising:

sensing, via the payload interface, a resistance on the at least one payload connection cable; and supplying a voltage to the payload based on the sensed resistance.

13. The method of claim 11, wherein the payload interface is configurable by a user to select one of a plurality of resistances, and wherein the method further comprises:

sensing, via the payload interface, the selected resistance of the plurality of resistances; and supplying a voltage to the payload based on the sensed resistance.

14. The method of claim 11, wherein the payload connection cable has no more than twelve conductors, and wherein each of the conductors connects to a respective pin of the plurality of pins disposed on the at least one modular payload connection port.

15. The method of claim 10, further comprising:

receiving, via the user device, user input to select a power mode for the at least one modular payload connection port, wherein the power mode is one of a user-selected voltage mode and an auto-detected voltage mode.

16. The method of claim 10, wherein the plurality of communication protocols comprises at least two of:

an Ethernet protocol;

a serial RS232 protocol;

a serial RS485 protocol;

a general-purpose input/output (GPIO) protocol;

a national marine electronics association (NMEA) protocol; and a user-defined protocol.

17. The method of claim 16, further comprising:

receiving, via the user device, at least one user selection of a configuration setting of the first communication protocol.

18. The method of claim 10, wherein the vehicle is a solar-powered autonomous boat.

19. A system for rapid payload interchangeability in an autonomous vehicle, comprising:

a vehicle, comprising:

a payload interface;

at least one modular payload connection port associated with the payload interface, wherein the at least one modular payload connection port comprises a plurality of pins, and wherein each of the plurality of pins is connected to the payload interface; and a user device, wherein the user device is configured to, for the at least one modular payload connection port:

receive a user selection of a first communication protocol from the plurality of communication protocols, and wirelessly transmit the user selection of the first communication protocol to the payload interface, wherein the payload interface is configured to, for the at least one modular payload connection port:

enable only some of the plurality of pins based on the first communication protocol, and wherein the user device is further configured to receive user input to select a power mode for the at least one modular payload connection port, wherein the power mode is one of a user-selected voltage mode and an auto-detected voltage mode.

20. A method for rapid payload interchangeability in an autonomous vehicle, comprising:

connecting a payload to a modular payload connection port of the autonomous vehicle, wherein the modular payload connection port comprises a plurality of pins connected to a payload interface associated with the modular payload connection port;

receiving, via a user device, a user selection of a first communication protocol from the plurality of communication protocols;

wirelessly transmitting, via the user device, the user selection of the first communication protocol to the payload interface;

enabling only some of the plurality of pins based on the first communication protocol; and receiving, via the user device, user input to select a power mode for the at least one modular payload connection port, wherein the power mode is one of a user-selected voltage mode and an auto-detected voltage mode.

* * * * *